United States Patent [19]

Aylott

[11] 3,935,872

[45] Feb. 3, 1976

[54] PACKAGING OF ARTIFICIAL EYELASHES

[75] Inventor: Eric V. Aylott, Cwmbran, England

[73] Assignee: Eylure Limited, England

[22] Filed: Mar. 1, 1974

[21] Appl. No.: 447,436

[30] Foreign Application Priority Data

Aug. 3, 1973 United Kingdom ..... 36971/73
Sept. 26, 1973 United Kingdom ..... 45100/73

[52] U.S. Cl. ..... 132/88.7; 132/31 A
[51] Int. Cl.² ..... A45D 40/26
[58] Field of Search ..... 132/88.7, 1, 31, 73

[56] References Cited

UNITED STATES PATENTS

| | | | |
|---|---|---|---|
| 2,288,386 | 6/1942 | Belden | 132/73 |
| 3,333,593 | 10/1966 | McGivern | 132/31 |
| 3,511,248 | 5/1970 | Panda | 132/1 |

*Primary Examiner*—G. E. McNeill
*Attorney, Agent, or Firm*—Blum, Moscovitz, Friedman & Kaplan

[57] ABSTRACT

An eyelash presentation pack has two removable applicators on each of which an eyelash set is mounted with the convex side of each set in contact with the applicator. Each eyelash set has had its base strand precoated with an adhesive such that on removal of an applicator, which includes a handle portion and an arcuate portion supporting the set, the set may be readily applied to a user's eyelid.

3 Claims, 13 Drawing Figures

Figure 1:
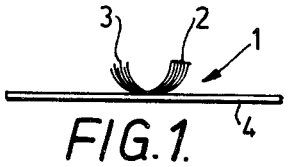

FIG. 9.
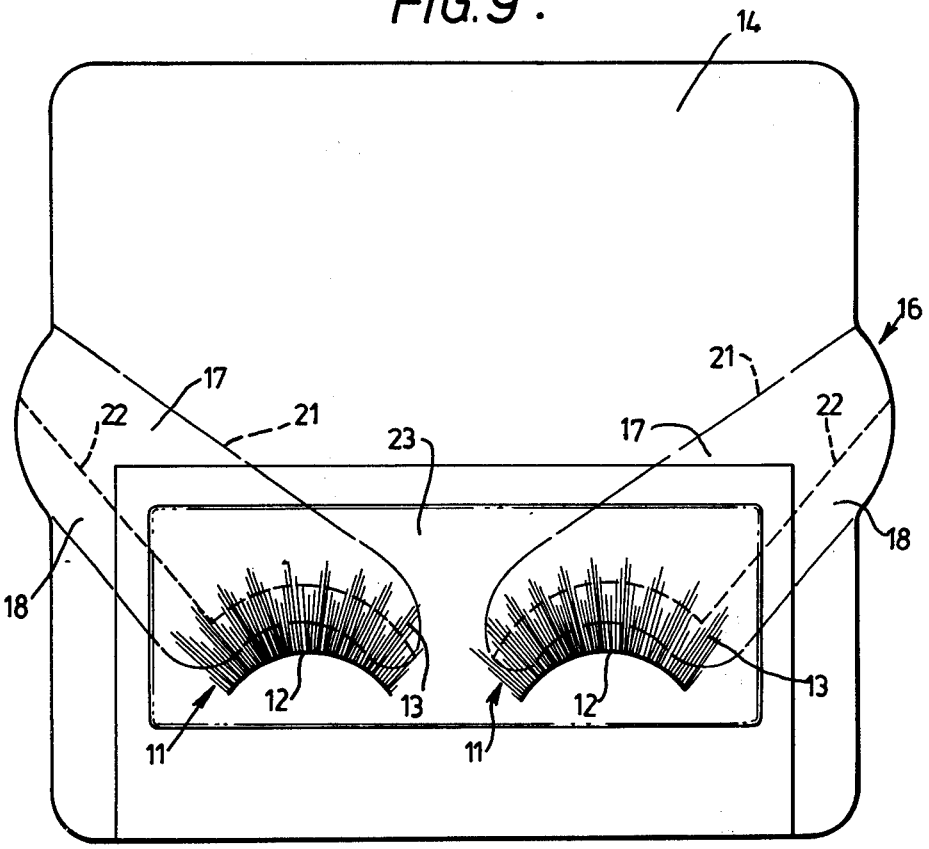
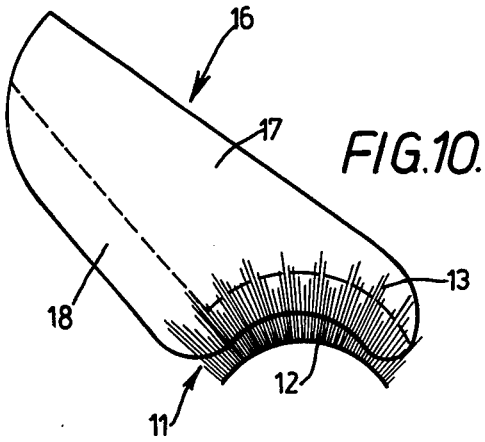
FIG. 10.
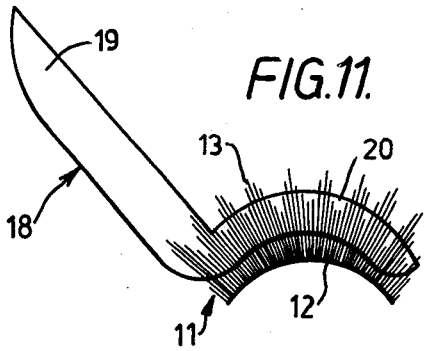
FIG. 11.

FIG.12.
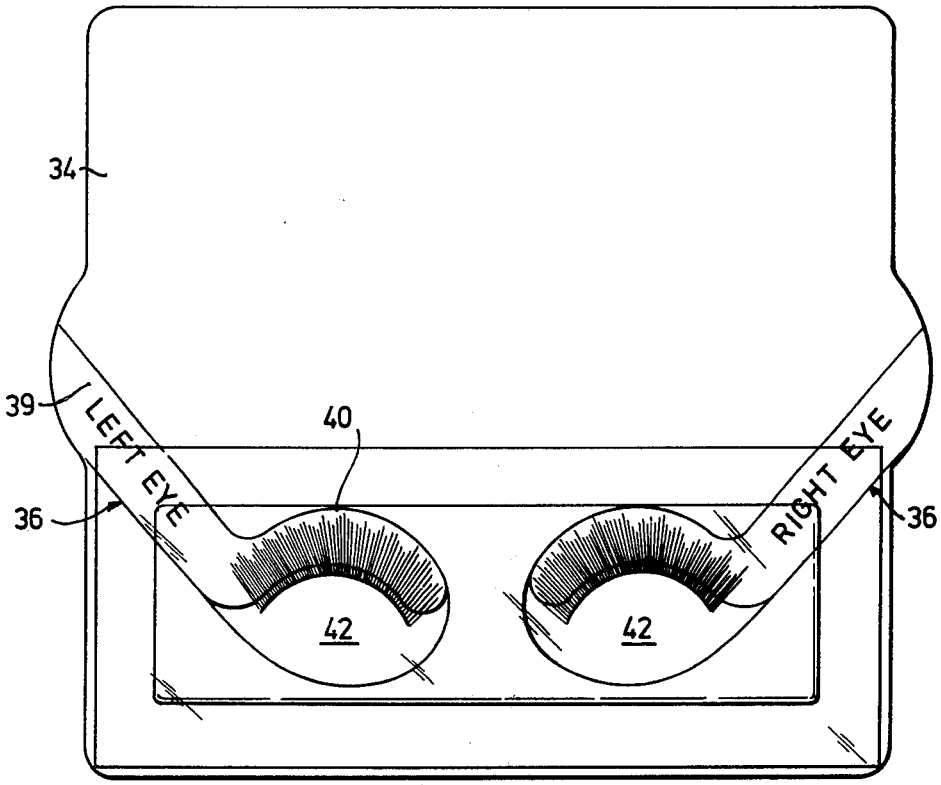
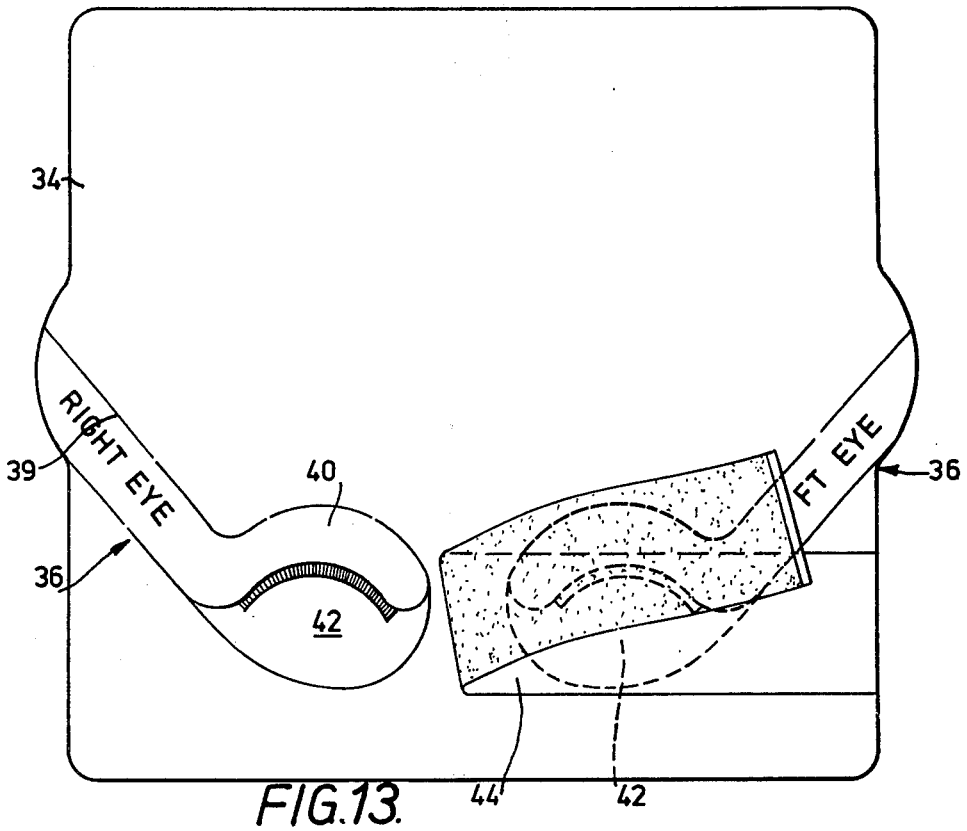
FIG.13.

PACKAGING OF ARTIFICIAL EYELASHES

This invention is concerned with the presentation of artificial eyelashes and particularly with the packaging and display of artificial eyelashes which incorporates a novel way of applying a set of artificial eyelashes to the person and the invention includes the provision of an assembly comprising an artificial eyelash set mounted ready for use upon an applicator.

Natural eyelashes normally sweep upwards in a gentle curve and artificial eyelashes are therefore similarly curved so as to look as natural as possible. In the past artificial eyelash sets have best been presented mounted side by side on vacuum formed insets in a pack. Eyelash sets presented in that way were often attached to the inserts by means of a self-adhesive substance on the base strand of each set. It was originally intended that when the eyelash sets were removed from the insets they would stick to a persons eyelid without the use of further adhesive. However in practice on removal of an eyelash set from an inset an amount of adhesive was left behind so that insufficient adhesive remained on the base strand to apply the eyelash set satisfactorily to the eyelid. Consequently in order to apply an eyelash set presented in that way to the person it was necessary to apply extra adhesive to the base strand before use and many people found that operation both tedious and messy.

According to the present invention there is provided an artificial eyelash set and applicator assembly wherein the eyelash set is removably mounted convex side downwards upon an applicator which comprises a handle by means of which the assembly may be manipulated and a support on which the eyelash set is mounted. The eyelash set is preferably secured in position on the support by means of a suitable adhesive applied to the support as an arcuate continuous strip or an arcuate series of adhesive dots.

The invention also includes an eyelash presentation pack comprising a base member, a pair of eyelash applicators forming a part of the base member and each having a handle by means of which the applicator may be manipulated and a support upon which an eyelash set is mounted with the convex side of each in contact with and secured upon the surface of the support by means of an adhesive.

According to a feature of the invention it is therefore proposed to attach a set of eyelashes firstly to a removable applicator incorporated in a pack to attach the set to the applicator by securing the actual hairs of the eyelashes to the applicator, the hairs being held lightly in place by small amounts of a self-adhesive substance pre-coated onto the flat surface of the applicator. By attaching the eyelashes in this manner the base strands of the eyelashes are left free and do not make contact with any surface prior to attachment to a person's eyelid.

It has been found that eyelash sets presented in this manner and attached to removable applicators can be applied to a person's eyelid without the use of any further adhesive in a speedier and more simple manner than was previously possible.

The invention also provides an improved method of mounting artificial eyelash sets on an applicator comprising mounting each eyelash set with the convex side of the eyelash set removably secured to the applicator. Preferably the applicator is coated with a thin arcuate strip or line of dots of adhesive and an eyelash set is then mounted in position on the adhesive and lightly held in place. The applicator may be of any suitable material e.g. cardboard or a plastics material and may form part of a pack or be an insert for a pack.

Figure 2:
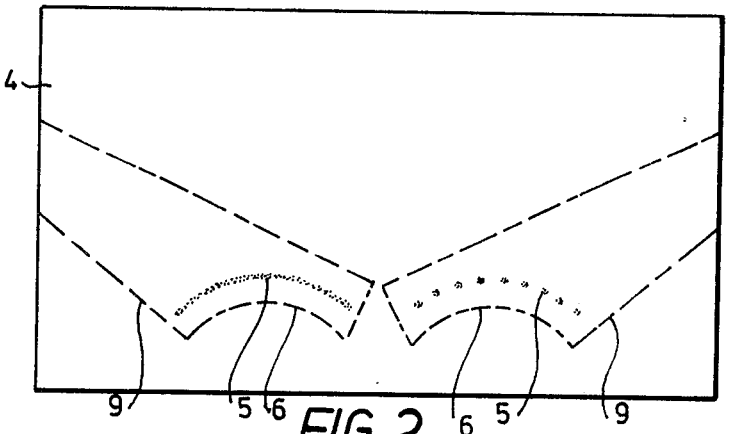
Figure 3:
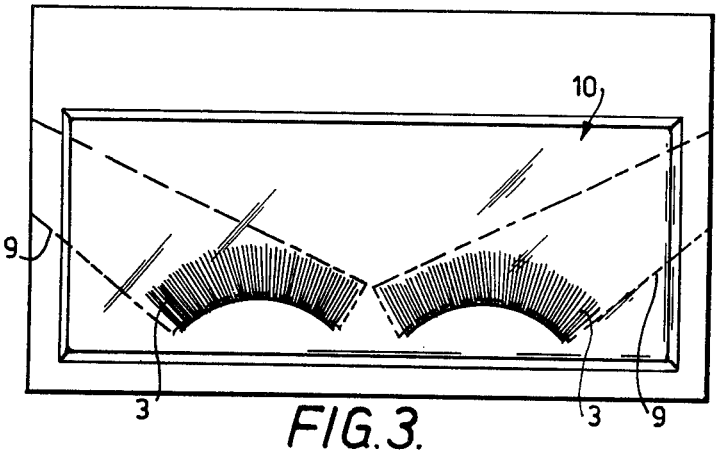
Figure 4:
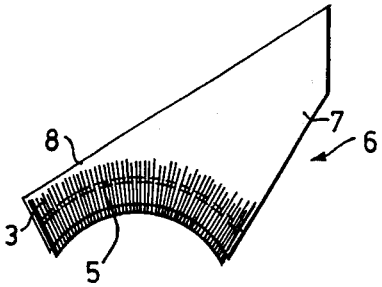
Figure 5:
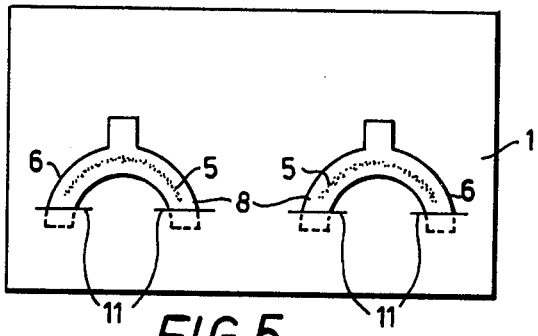
Figure 6:
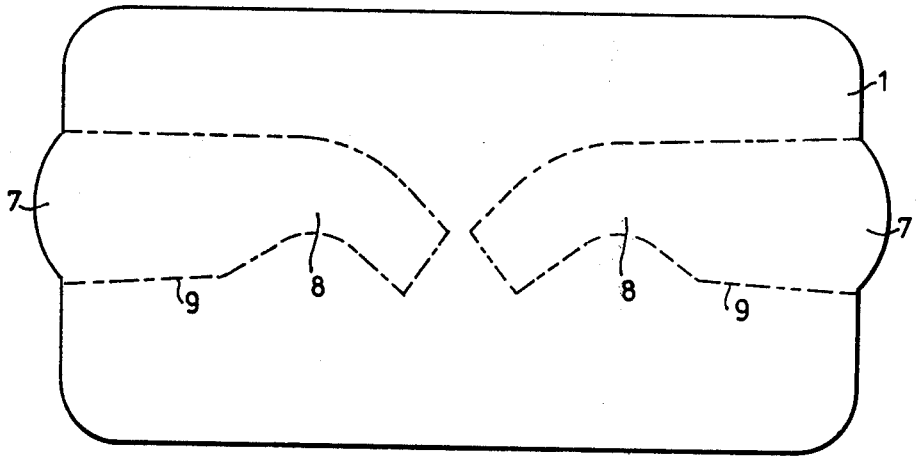
Figure 8:
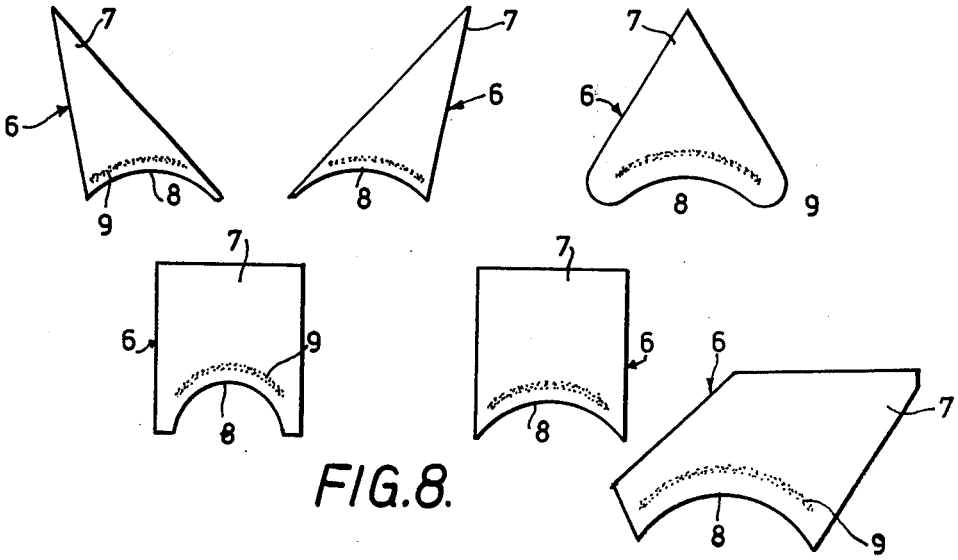
Figure 7:
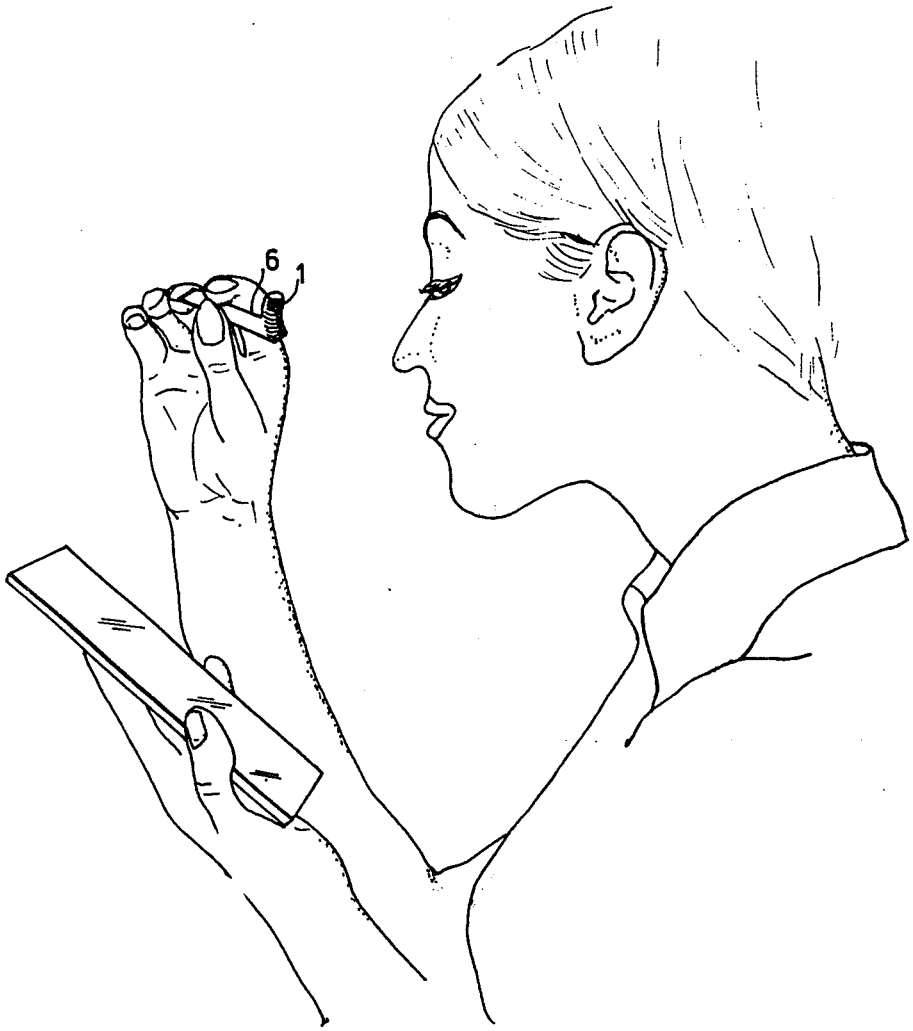

In order that the invention may be more clearly understood and readily carried into effect the invention will now be described by way of example with reference to the accompanying drawings in which:

FIG. 1 is a side elevation of an eyelash set mounted in accordance with the invention, FIG. 2 is a plan view of a suitable base member including a pair of applicators, FIG. 3 is a plan view similar to FIG. 2 of eyelashes mounted on the applicators, FIG. 4 is a plan view of an applicator and eyelash set assembly detached from the base member ready for application, FIG. 5 is a plan view of an alternative set of applicators, attached to the base member by the ends of each applicator slotted into slits cut into the base member, FIG. 6 is a plan view of a further alternative base member, FIG. 7 illustrates an applicator in use, FIG. 8 illustrates various alternative suitable shapes of applicator, FIG. 9 is a plan view of eyelashes mounted convex side down upon two modified applicators each removably secured to a base member of a presentation pack, FIG. 10 is a plan view showing one of the applicators in FIG. 9 removed from the base member, FIG. 11 is a plan view of the applicator of FIG. 10 with a part thereof removed, FIG. 12 is a top plan view of a further modification and FIG. 13 is a bottom plan view of FIG. 12 showing the protective cover being removed.

In the drawings an eyelash set 1 of arcuate shape in side elevation has a base strand 2 and lashes 3 and is mounted with the convex side of the eyelash set 1 removably secured to a support 4 by a suitable adhesive. The adhesive is preferably applied to the support 4 in the form of an arcuate strip or arcuate series of adhesive dots 5 as clearly shown in FIG. 2.

Many persons will find that an applicator is a great help in applying an eyelash set to the person and therefor in accordance with a feature of the invention the eyelash sets are each mounted on a suitable applicator 6 having a grip or handle portion 7 and an arcuate support 8 — this is clearly seen from most of the accompanying drawings. With particular reference to FIGS. 3 and 4 it will be seen that the arcuate strip or arcuate series of adhesive dots 5 is disposed upon the arcuate support 8 of each of the applicators and that the eyelash set mounted on an applicator is mounted such that in plan the base strand 2 of each set overlaps the applicator 6.

In a preferred embodiment we use a base member 4 shaped by means of scored or weakened lines 9 to provide two applicators 6 each adapted to support a single eyelash set as described above. Preferably the eyelash sets are mounted in a protective acetate or like transparent cover 10 and when it is desired to use the eyelash sets the applicators are removed from the base member 4 from the rear by tearing along the lines 9 to provide two applicators as illustrated in FIG. 4. To facilitate tearing it is preferable to allow the weakened lines 9 to extend to the sides of the base member 4.

Preferably each eyelash set (FIG. 1) is coated along its base strand 2 with a self-adhesive.

As an alternative FIG. 5 illustrates an arrangement in which the base member 4 is provided with separate appplicators 6, the ends of the arcuate support 8 of each applicator being inserted into slots 11 in the base member 4.

In use applicators with eyelash sets already mounted thereon are removed from the pack either by tearing along the weakened lines 9 (FIG. 3) or by removing the applicator from retaining slots 11 (FIG. 5). The applicator is then moved to the eye of the user and the base strand 2 of the eyelash set applied to the user's eyelid. As the adhesive on the base strand 2 is much heavier and stronger than the adhesive by which the eyelash set is secured to the applicator the eyelash set is retained on the eyelid and the applicator may be removed: application of an eyelash set 1 mounted on an applicator is illustrated in FIG. 7.

Although the invention has been particularly described with the eyelashes attached to the applicators by a suitable adhesive it is understood that the eyelashes may be attached to the applicators in any other convenient manner e.g. the lashes may be secured to the applicators by a simple plastics or metal clip device which may be quickly released when so desired or they may be attached by a combination of adhesive and such a clip device.

We have therefore provided an improved way of fixing and presenting artificial eyelashes in which the eyelashes are mounted convex side downwards upon an arcuate shaped applicator including a grip or handle by means of which the eyelash set can be manipulated and a support to receive the eyelash set and having an arcuate strip or arcuate series of dots of adhesive to receive the eyelash set.

FIG. 6 illustrates a base member with applicators of a rather different shape as compared with those of FIG. 3 and FIG. 7 shows examples of different shapes in which applicators may be made.

Referring now to FIGS. 9, 10 and 11 an eyelash set 11 of arcuate side elevation has a base strand 12 and lashes 13 and is mounted with the convex side of the eyelash set removably secured to a support forming part of a base member 14 by a suitable adhesive. The adhesive is as before preferably applied to the support in the form of an arcuate strip or arcuate series of adhesive dots.

The eyelash sets 11 are each mounted on a suitable applicator 16 having a first part 17 and a second part 18, the second part 18 forming a grip or handle portion 19 and an arcuate support 20.

From the accompanying FIGS. 9 to 11 it will clearly be seen that the eyelashes are mounted upon the arcuate support 20 of the second part 18 of the applicator and are mounted in such a way that in plan the base strands 12 overlap the applicator.

In the preferred embodiment the base member 14 is shaped by means of scored or weakened lines 21 to provide two applicators 16. Each applicator 16 includes a further scored or weakened line 22 to divide the applicator 16 into the two parts 17 and 18.

Preferably the eyelashes are mounted in a protective acetate or like transparent cover 23 and when it is desired to use the eyelashes the applicators are removed from the base member 14 from the rear by tearing along the lines 21 to provide two applicators as illustrated in FIG. 10. The second part 18 of the applicators is then separated from the first part 17 by tearing along the weakened line 22 (FIG. 3). On removal of the second part 18 from the first part 17 the second part 18 is moved to the eye of the user and the overlapping base strand 12 of the eyelash set, mounted on the second part, applied to the users' eyelid.

The eyelashes are only preferably removably secured to the applicators by adhesive and may be removably secured in any other convenient manner. The applicators are preferably made of cardboard material.

FIGS. 12 and 13 illustrate a further modification in which a base member 34 includes two applicators 36 each including an elongated slender grip part 39 and an arcuate support 40. Below the supports 40 the base member 34 is cut away to provide openings 42 to facilitate removal of the applicators from the base member. underneath the base member a tear away protective strip 44 is provided which covers the openings 42 and assists in holding the applicators in position.

In order to release the sets of lashes from the pack for use the following steps should be taken:

1. peel off the protective strip 44 in the manner indicated in FIG. 13

2. carefully remove the applicator and lash set for the right eye 3. hold the applicator level with the eyelid, look down into a mirror and place the lash set firmly into position on the centre of the eyelid immediately above the roots of the natural lashes 4. to dispose of the applicator use a slight wrist movement to tilt the applicator upwards to free the lash set. Once the applicator is disconnected from the lash set carefully withdraw the applicator in a downward direction leaving the lash set in position for final adjustment 5. repeat the process for the left eye.

I claim:

1. An artificial eyelash set and applicator assembly wherein the eyelash set is convex in side elevation having a base strand and a plurality of lashes attached to the base strand and an applicator having a handle by means of which the applicator may be manipulated and a support upon which the eyelash set is mounted said eyelash set being removably secured along a tangent of the set with the convex side of the eyelash set in contact with and secured upon the support of the applicator so that the base strand is free of the applicator.

2. An assembly according to claim 1 wherein the eyelash set is secured in position on the support by a suitable adhesive applied to the support in the form of an arcuate series of adhesive dots.

3. An assembly according to claim 1 wherein the applicator is a removable part of a base member.

* * * * *